US008109400B2

(12) United States Patent
Langston et al.

(10) Patent No.: US 8,109,400 B2
(45) Date of Patent: Feb. 7, 2012

(54) INDUSTRIAL PACKAGE HAVING PRESSURIZATION CAPABILITY

(75) Inventors: Andrew K. Langston, Wilmington, NC (US); Carlton Wayne Clark, Wilmington, NC (US); David Grey Smith, Leland, NC (US); Thomas C. Ware, Carolina Beach, NC (US); William A. Scott, Rocky Point, NC (US)

(73) Assignee: Global Nuclear Fuel-Americas, LLC., Wilmington, NC (US)

( * ) Notice: Subject to any disclaimer, the term of this patent is extended or adjusted under 35 U.S.C. 154(b) by 1363 days.

(21) Appl. No.: 11/987,843

(22) Filed: Dec. 5, 2007

(65) Prior Publication Data

US 2009/0145907 A1 Jun. 11, 2009

(51) Int. Cl.
*B65D 88/00* (2006.01)

(52) U.S. Cl. ..... 220/1.5; 220/263; 220/526; 220/646; 220/652; 220/694; 220/849

(58) Field of Classification Search ..... 220/1.5, 220/263, 526, 646, 652, 694, 849
See application file for complete search history.

(56) References Cited

U.S. PATENT DOCUMENTS

| | | | | |
|---|---|---|---|---|
| 4,844,280 | A * | 7/1989 | Purdy | 220/646 |
| 4,860,911 | A * | 8/1989 | Jones, Sr. | 220/1.5 |
| 7,186,994 | B1 * | 3/2007 | Spruce | 250/507.1 |
| 2004/0055922 | A1 * | 3/2004 | Ordonez | 206/524.5 |
| 2005/0150187 | A1 * | 7/2005 | Raming | 53/415 |
| 2006/0081628 | A1 * | 4/2006 | Myers et al. | 220/1.5 |

* cited by examiner

*Primary Examiner* — Anthony Stashick
*Assistant Examiner* — Elizabeth Volz
(74) *Attorney, Agent, or Firm* — Harness, Dickey & Pierce, P.L.C.

(57) ABSTRACT

Example embodiments are directed toward industrial packages. Example embodiments may meet several packaging requirements for different modes of transport, including both roadway and flight regulations such as Department of Transportation (DOT) Class 7 requirements for ground transport of radioactive materials and International Air Transport Association (IATA) Regulations for air transport of radioactive materials. Example embodiments may include integrated bumpers, specialized bottom tube skids, lid lattice support, multiple gasket pressurization seal, corner reinforcement, and/or multiple shielding and modular interior components.

19 Claims, 6 Drawing Sheets

Figure 3 – Detail B

Figure 4 – Detail A

INDUSTRIAL PACKAGE HAVING PRESSURIZATION CAPABILITY

BACKGROUND

1. Field

Example embodiments generally relate to containers used for industrial transportation, specifically transportation of radioactive materials.

2. Description of Related Art

Generally, transportation of any large-scale industrial machinery or component requires specialized packaging that complies with regulations regarding the nature of such transportation. Related art industrial packages are typically engineered to both protect the transported component and meet regulatory requirements that in turn protect the transportation system and public at large.

Radioactive materials have specialized transport requirements to safeguard the nation's transportation system and public from the dangers inherent in exposure to radioactivity. Related art industrial packages may comply with only the Department of Transportation regulations governing the transport of radioactive materials on public interstates and other roadways. The regulations may define a number of physical requirements for related art industrial packages, including, for example, size, strength, and resistance to elements encountered in transport.

SUMMARY

Example embodiments are directed toward industrial packages configured to transport a variety of radioactive materials while meeting several distinct packaging requirements for different modes of transport, including roadway, rail, air, and sea. Example embodiment industrial packages may comply with 1) Department of Transportation (DOT) Class 7 requirements for ground transport (both road and rail) of radioactive materials, 2) International Air Transport Association (IATA) Regulations for air transport of radioactive materials, and 3) International Maritime Dangerous Goods (IMDG) code for waterway transport of radioactive material.

Example embodiment industrial packages may include one or more features that ensure multiple regulatory compliance while providing packaging and containment for radioactive materials. Example features may include integrated bumpers, specialized bottom tube skids, lid lattice support, multiple gasket pressurization seal, corner reinforcement, multiple shielding and modular interior components, and/or multiple pressurization valves and filters.

BRIEF DESCRIPTIONS OF THE DRAWINGS

Example embodiments will become more apparent by describing, in detail, example embodiments thereof with reference to the attached drawings, wherein like elements are represented by like reference numerals, which are given by way of illustration only and thus do not limit the example embodiments herein.

DETAILED DESCRIPTION

Figure 1:
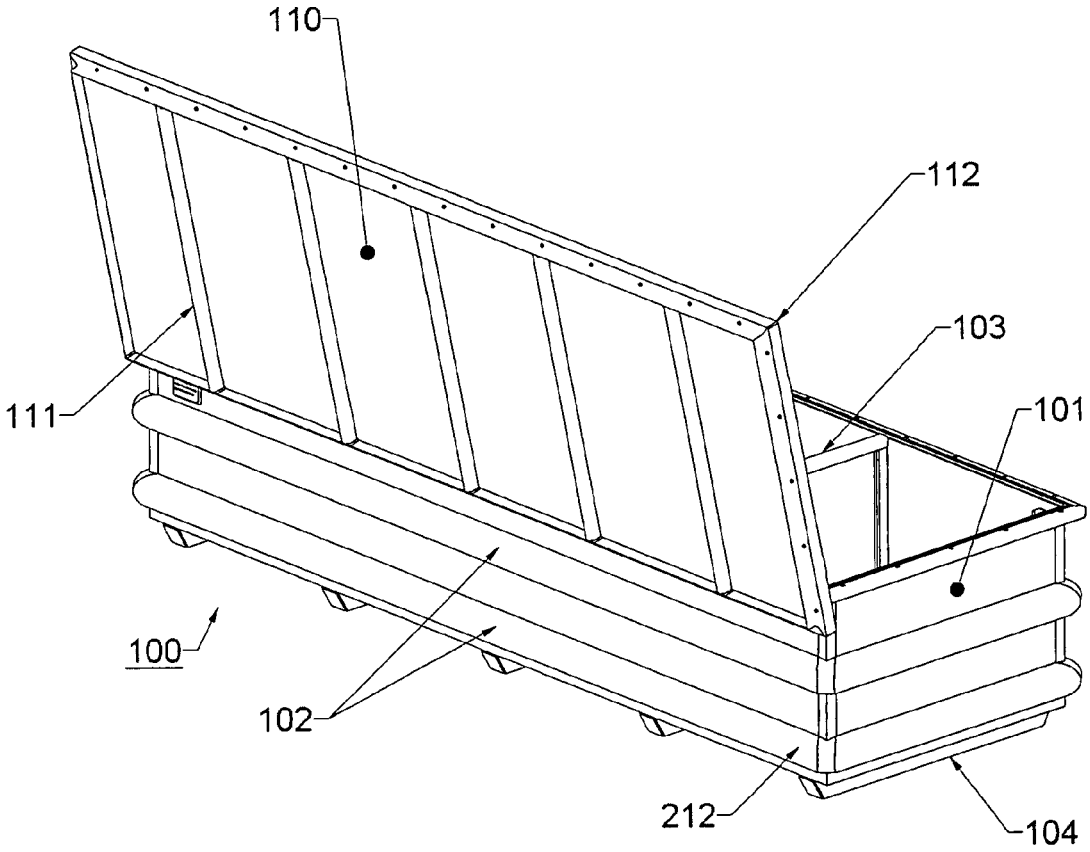
FIG. 1 is an isometric back view of an example embodiment industrial package.

Detailed illustrative embodiments of example embodiments are disclosed herein. However, specific structural and functional details disclosed herein are merely representative for purposes of describing example embodiments. The example embodiments may, however, be embodied in many alternate forms and should not be construed as limited to only example embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected," "coupled," "mated," "attached," or "fixed" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the language explicitly indicates otherwise. It will be further understood that the terms "comprises", "comprising," "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Example embodiment industrial packages may meet several packaging standards in combination such that example embodiment industrial packages may be transported in several different modes requiring distinct standards not met by related art industrial packages.

For example, example embodiments may provide a Department of Transportation (DOT) Type 7A compliant industrial package. Type 7A packaging is certified to contain and transport radioactive materials, known as Class 7 materials, on national roadways. DOT 7A requirements are defined at 49 C.F.R. §§178.30 & 173.465. These regulations define DOT 7A packaging for radioactive materials as passing a water spray test, a free drop test, a stacking test, a penetration test, and a pressurization test. The water spray test requires DOT 7A packaging to be exposed to an equivalent of approximately 2 inches/hour of rainfall without package absorption or retention of water. The free drop test requires DOT 7A packaging to maintain structural integrity of all features, without breach, upon a 4-foot dead drop on the feature being tested. The stacking test requires DOT 7A industrial packages to maintain structural integrity when loaded by stacking the package with 5 times the industrial package weight. The penetration test requires DOT 7A industrial packages to be subject to a 13.2 pound bar dropped from a height of 3.3 feet without penetrating the containment features of the packaging. The pressurization test requires DOT 7A packaging to possess a nuclear-grade filter capable of equalizing internal pressure of the package in the event of environmental overpressure.

Example embodiments may further comply with International Air Transport Association (IATA) Regulations for air transportation. IATA-compliant industrial packaging is capable of maintaining an internal pressure of at least one atmosphere (14.7 lbs/in$^2$) in the event of environmental underpressure, as encountered on high-altitude flights.

Further, example embodiment industrial packages may comply with International Maritime Dangerous Goods (IMDG) code for waterway transport of radioactive material. IMDG Code 7 defines the required parameters for industrial containers for radioactive materials. These parameters may be satisfied by complying with the previously-discussed standards and further by providing a watertight, water-proof (up to shipping depth) industrial package.

Because example embodiment industrial packages may comply with several modes of transportation regulations, example embodiment packages may be capable of both international road, rail, air, and sea transportation without the need for repackaging or recertification.

FIG. 1 shows an example embodiment top-loading industrial package 100. Example embodiment industrial package 100 is shown as a generally hollow hexahedron; however, other shapes, such as cubic, cylindrical, etc., may be used. Example embodiment industrial package may include a body 101 enclosed by a lid 110. The body 101 may be fabricated from a non-corrosive material having thickness adequate to support up to five times the weight of example embodiment industrial packages including, for example, 0.125 inch aluminum. The body 101 may be fabricated by full-length interior and exterior welds to provide an air-tight enclosure.

The body 101 may include features that further aid example embodiment industrial packages meet the above discussed standards. One or more bumpers 102 may extend around the body 101 and be integrated with the body 101 through continuous welds. Bumpers 102 may stiffen the body 101 against impact and pressure forces. Bumpers 102 may be fabricated from a material similar to the body to ensure weld compatibility and strength, including, for example, 0.25 inch aluminum.

Tube skids 104 may be integrated with a bottom of the body 101. Tube skids 104 may further increase body 101 rigidity and strength. Tube skids 104 may be hollow and tapered to facilitate forklift access under example embodiment industrial package 100 by providing a vertical clearance and/or spacing. Tube skids 104 may be fabricated of materials similar to the body 101 to ensure weld compatibility and strength, including, for example, 4×4 in., 0.25-in thick aluminum tubes.

Lid 110 may be fabricated of similar materials as body 101 and may be shaped to fit over and close the body 101 when moved to a closed position over the body 101. Lid 110 may include a removable lid lattice support 111 that, like the tube skids 104 and bumpers 102 for the body, reinforces the lid 110 against pressurization forces by providing a rigid lattice supporting the lid 110. The lid lattice support 111 may be removable from the lid 110 by affixing only to edges of the lid 110. In this way the lid lattice support 111 may provide resistive tension at the edges of the lid 110 countering the inward motion of the edges should the lid 110 begin to bend or buckle under pressure. Alternatively, lid lattice support 111 may be removed in order to reduce the weight of example embodiment industrial package 100 in necessary circumstances.

Lid 110 may further include a collapsible corner reinforcement 112 that protects the lid 110 and seal (discussed below) from the 4-foot test on the corner. The reinforcement 112 may be hollow and collapse or "crumple" under sufficient impact so as to absorb and redistribute impact forces on the lid during impact. Lid 110 and reinforcement 112 may be fabricated from an appropriate non-corrosive material having strength to withstand the above described tests, including, for example, 0.125 in. aluminum. Reinforcement 112 may be welded along the edge of the lid 110 to present a continuous union between the lid 110 and reinforcement 112.

Figure 2:
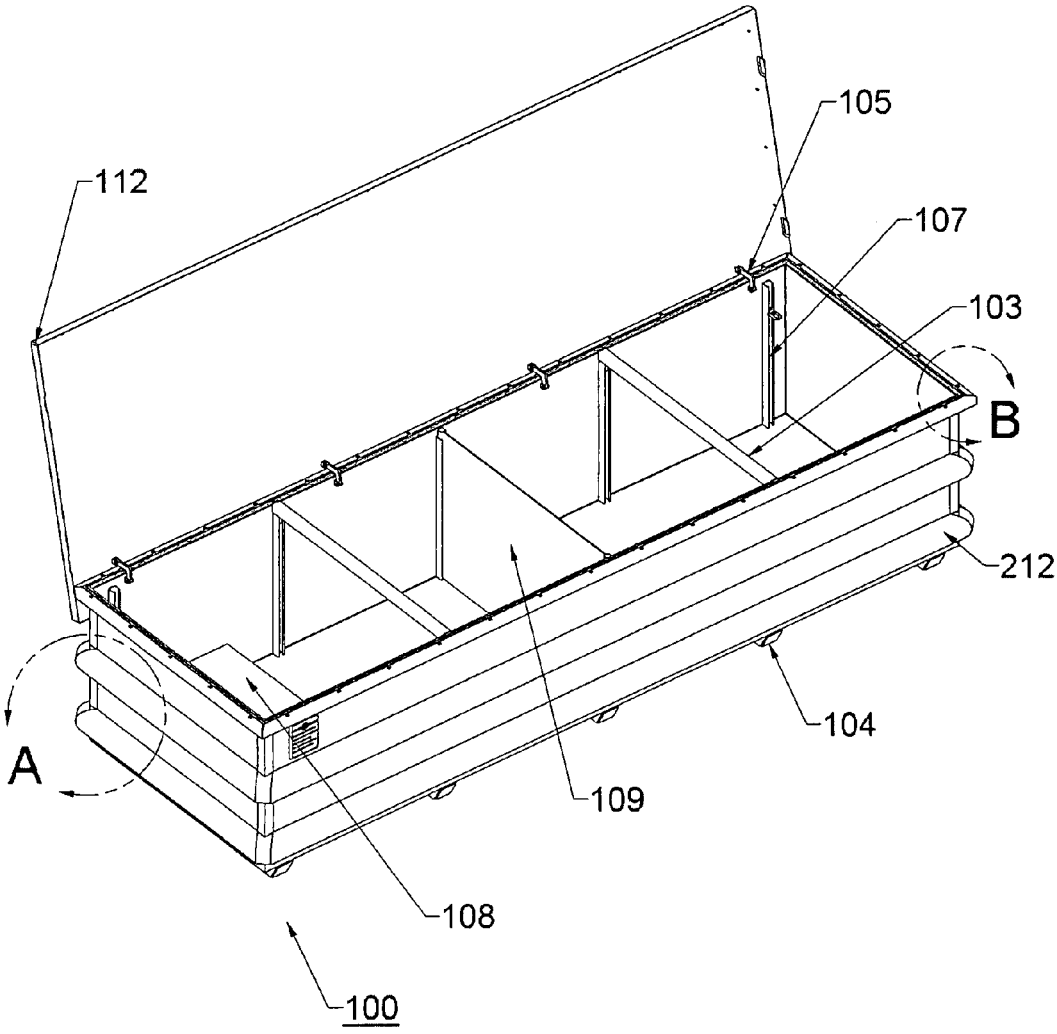
FIG. 2 is an isometric front view of an example embodiment industrial package.

FIG. 2 illustrates a front isometric view of an example embodiment top-loading industrial package 100. In FIG. 2, mechanisms for joining the lid 110 and body 101 are shown generally by articulated hinges 105. Hinges 105 may affix to both the lid 110 and body 101 by appropriate bolting or welding. Hinges 105 may be L-shaped and hinged at a corner of the "L" so as to articulate (expand) when the lid 110 is opened by rotating the lid 110 about the hinged edge of the body 101. In this way, hinges 105 may permit the lid 110 to open beyond 90-degrees, or beyond vertical, with respect to the body 101, permitting greater access to example embodiment industrial package 100. Hinges 105 may be made of an appropriately strong, non-corrosive material including, for example, aluminum. Any bolts or pins used in joining the hinge 105 may be fabricated from stainless steel. Although the lid 110 is shown affixed to the body 101 by hinges 105 in an example embodiment, other joining mechanisms, for example, a sliding lid or a screw-on lid secured by fasteners 114 (shown in FIG. 5), may be used to permit an air-tight seal and pressurization of the closed structure.

Figure 3:
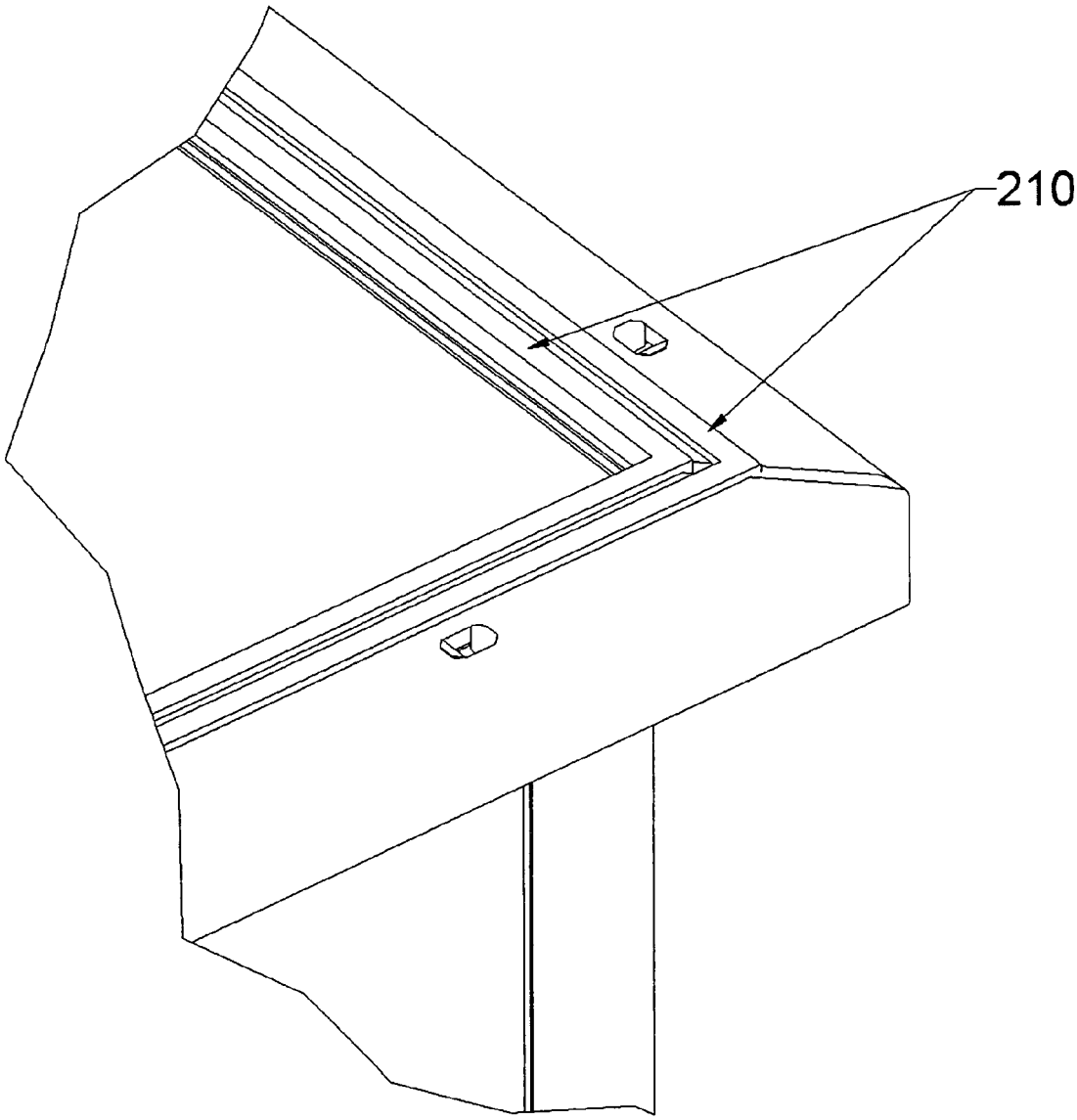
FIG. 3 is a detailed view of an example seal feature of example embodiment industrial packages.

FIG. 3 illustrates a detail of the top of the body 101 where the lid 110 may rest on the body 101. As shown in FIG. 3, a multi-seal 210 may be placed between the lid 110 and body 101 so as to make the closed example embodiment industrial package 100 air-tight and capable of pressurization. Multi-seal 210 may be embodied by a variety of known sealing mechanisms. The example multi-seal 210 shown in FIG. 3 is a double gasket type seal that may extend completely around the top of the body 101. The example multi-seal 210 may include neoprene, high-temperature silicone, natural rubber, viton, etc. and may have a thickness of approximately 0.75 in. or thicker to maintain an internal pressure of at least 1 atmosphere in example embodiment industrial packages.

Referring again to FIG. 2, example embodiment industrial packages 100 may include a number of interior features that further permit compliance with the above-described standards. Internal lid supports 103 may internally attach to the body 101 and support the lid 110 during an overpressure event or stacking in which the lid may be compressed against the lid supports 103. Internal supports 103 may allow the lid 110 to have less mass and thus be easier to lift while still meeting stacking and/or penetration/impact standards. Lid supports 103 may be fabricated from any sufficiently strong, non-corrosive material such as aluminum and/or stainless steel.

Unistruts 107 and modular shielding 109 may permit for better interior management of example embodiment industrial packaging. Unistruts 107 may be mounted on an interior surface of the body 101 and permit modular internal component placement and tiedown. Unistruts 107 may further provide rigid support to the body 101 when example embodiment industrial packages are subject to various tests discussed above. Unistruts 107 may further provide for shielding 109 to be placed at a variety of positions within the example embodiment industrial package 100 to accommodate transport of radioactive materials. For example, increased neutron or gamma shielding 109 may be placed inside the body 101 on unistruts 107 in order to compartmentalize the example embodiment industrial package 100 and allow gamma and/or neutron radioactive components to be placed within those compartments without contaminating other compartments or leaking radiation outside the example embodiment industrial package 100.

Unistruts 107 may be fabricated from a non-corrosive, rigid material such as aluminum. Shielding 109 may be fabricated from an appropriate shielding material based on the radioactivity of any components being packaged. For example, a heavy metal such as lead may be used if a gamma-emitting source is to be transported, while, for example, a cadmium and/or borated aluminum shielding material may be used if a neutron-emitting source is to be transported. Alternatively, shielding 109 may be made of a thermally nonconductive in order to accommodate temperature sensitive contents.

Further, additional shielding box 108 may be placed within the example embodiment industrial package 100 and affixed to the interior of body 101 to provide even further shielding for high-activity tools or components. The shielding box 108 may be fabricated from an appropriate material as discussed above with regard to the shielding and may be adjoined welded and/or bolted to the interior of the body 101 to further compartmentalize the interior of example embodiment industrial packages.

Figure 4:
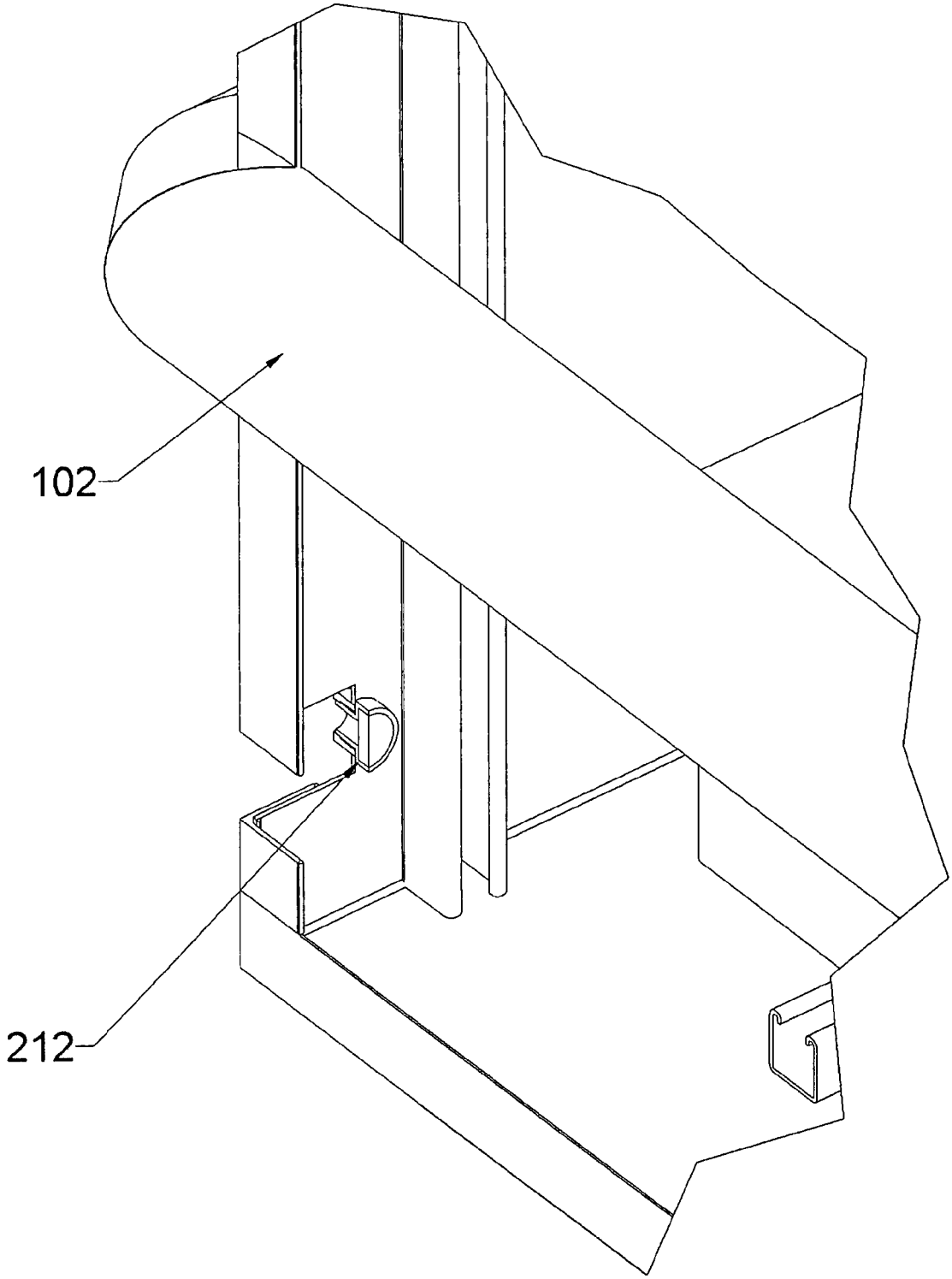
FIG. 4 is a detailed view of an example pressure valve feature of example embodiment industrial packages.

FIG. 4 is a detailed view of the example embodiment industrial package 100 showing a pressurization valve and filter 212 in the body 101. The pressurization valve and filter 212 may be a one-way valve that permits air inflow during overpressure events, such that the interior pressure of example embodiment industrial packages may be kept at or above 1 atmosphere. The valve/filter 212 may further prevent the escape or introduction of radioactive materials through the valve/filter 212. The valve 212 may not permit or may severely restrict outflow or depressurization. In this way, when the lid 110 is closed and sealed against the body 101, example embodiment industrial packages may be air tight and maintain an internal pressure of at least 1 atmosphere even in flight and may increase internal pressure if external pressure significantly increases.

Figure 5:
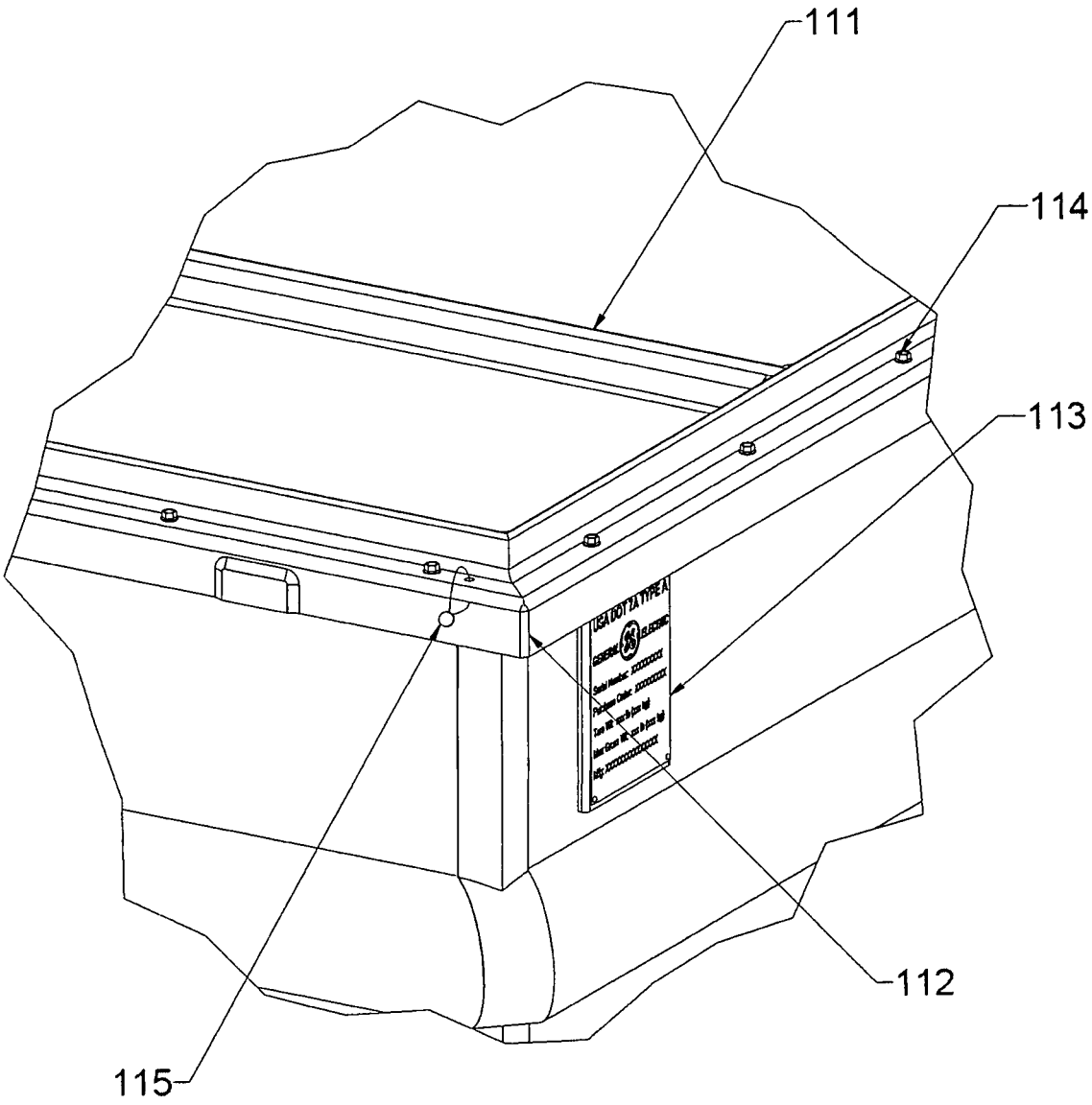
FIG. 5 is a detailed view of example indicia features of example embodiment industrial packages.

As shown in FIG. 5, lid 110 and/or body 101 may further include a first indicia 113 that indicates the contents of the example embodiment industrial package 100 and any regulatory required indicia, such as a country of origin or description of the contents as hazardous or radioactive. Second indicia 115 may include a tamper-evident indicator that displays if the lid has been lifted or seal (discussed above) broken prematurely or in transport. First and second indicia 113 and 115 may be used alone or in combination or placed in alternate locations so long as any regulatory required marking is included in the indicia and/or secondary indicia.

Figure 6:
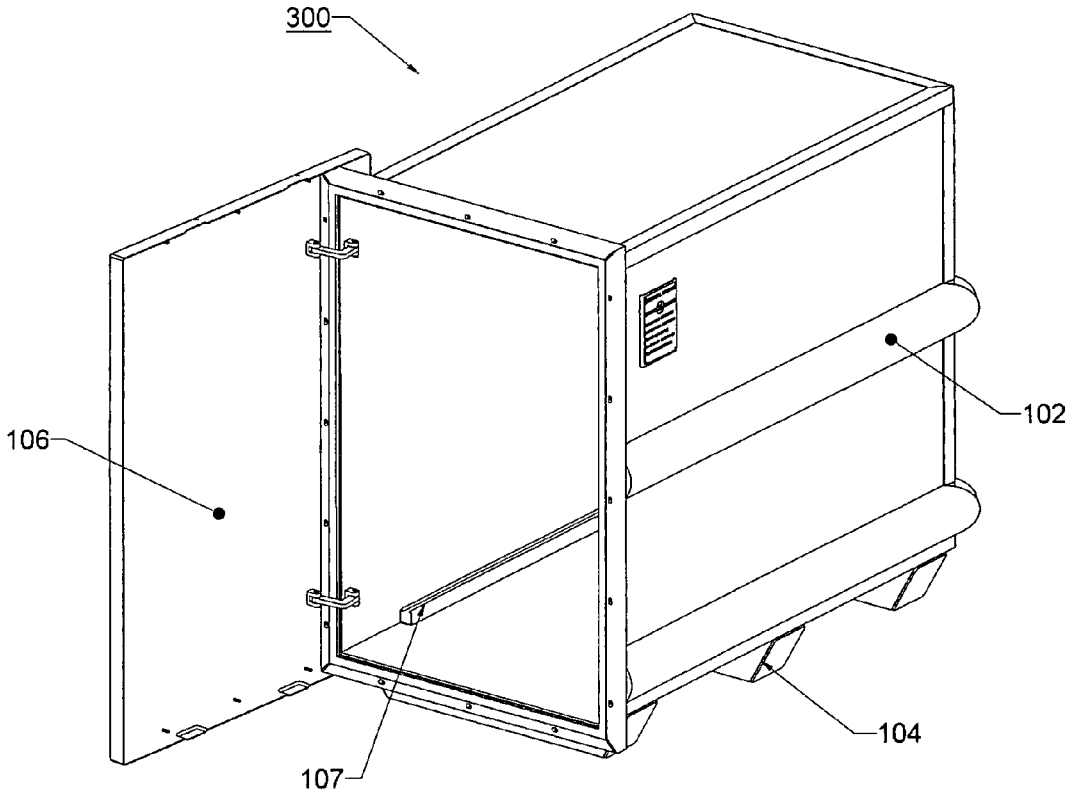
FIG. 6 is an isometric view of another example embodiment industrial package.

As shown in FIG. 6, another example embodiment end-loading industrial package 300 may include a removable end panel 106 that is detachable from the body to permit heavy and/or large component loading in example embodiment industrial packages. The end panel 106 may be removably attached to the body by a variety of known mechanisms including clamps, bolts, etc. The removable end panel 106 may further include a seal (not shown) to permit pressurization of the example embodiment industrial package 300. The example embodiment end-loading industrial package 300 may have unistruts 107 placed in different locations to accommodate end-loaded packages.

Example embodiment industrial packages may use materials meeting particular industry standards, such as ASTM and/or ASME for composition, strength, and other physical characteristics. Similarly, the continuous welding of example embodiments to provide air-tightness may comply with welding standards for radioactivity-management and pressurization.

The example embodiments described above may be varied in several ways, based on the application of example embodiments. For example, although an internal pressure of 1 atmosphere has been specified, different internal pressures may be maintained by example embodiment industrial packages based on the air-tight design of example embodiments. Further, the above-described features may not necessarily be present or may be present in any combination, depending on the application. For example, internal shielding 109 may not be used if non-radioactive materials are transported, and internal supports 103 and lid lattice supports 111 may be removed if example embodiment industrial packages are not stacked or do not need to meet the above-discussed regulatory criteria. Similarly, placement of features, such as valve/filter 212, may be changed without altering the functionality of example embodiment industrial packages.

Example embodiments and methods thus being described, it will be appreciated by one skilled in the art that example embodiments and example methods may be varied through routine experimentation and without further inventive activity. Variations are not to be regarded as departure from the spirit and scope of the exemplary embodiments, and all such modifications as would be obvious to one skilled in the art are intended to be included within the scope of the following claims.

What is claimed is:

1. An industrial package comprising:

a body having a hollow interior and at least one substantially open side;

a lid adjoining the body and movable about the body, the lid shaped so as to close the at least one substantially open side of the body when placed in a closed position; and a multi-seal between the body and the lid, the multi-seal configured to seal the lid and the body when the lid is placed in the closed position such that the industrial package is air-tight and maintains an independent internal pressure, the industrial package complying with a water spray test, a free drop test, a stacking test, a penetration test, and a pressurization test when the lid is sealed against the body, wherein the lid includes a lattice support configured to be removably attached to the lid, the lattice support being removable by only being attached to the edges of the lid.

2. The industrial package of claim 1, further comprising:

at least one hinge attached to the lid and the body, wherein the lid is rotatable about the body at the at least one hinge.

3. The industrial package of claim 1, wherein the lid includes at least one collapsible corner reinforcement, the collapsible corner reinforcement configured to collapse if exposed to a threshold impact force.

4. The industrial package of claim 1, wherein the body further includes at least one longitudinally extending internal lid support, each lid support having a length spanning a width or a length of the at least one substantially open side, each lid support having two ends with each end being attached to the body.

5. The industrial package of claim 1, wherein the body further includes a plurality of equally-spaced tube skids attached to a bottom surface of the body so as to create a clearance between the bottom surface and the ground.

6. The industrial package of claim 1, wherein the body further includes at least one unistrut attached to an interior of the body.

7. The industrial package of claim 1, wherein the lid and the body are fabricated from non-corrosive structural materials.

8. The industrial package of claim 1, wherein the body is fabricated only from continuous, sealed welds.

9. The industrial package of claim 1, wherein the lid further includes an indicia identifying at least one of the contents of the industrial package and a tamper-evident condition of the industrial package.

10. The industrial package of claim 1, wherein the body further includes at least one bumper attached to an exterior of the body, the at least one bumper running lengthwise along a side of the body and being configured to reinforce the body against pressure differences.

11. The industrial package of claim 1, wherein the water spray test, the free drop test, the stacking test, the penetration test, and the pressurization test each comply with Department of Transportation (DOT) Type 7A industrial packaging tests for transporting radioactive materials.

12. The industrial package of claim 1, wherein the multi-seal includes a double-gasket compressible material multi-seal configured to seat the lid and the body when the lid is in the closed position.

13. The industrial package of claim 12, wherein the multi-seal is configured to maintain an internal pressure of the industrial package of at least 1 atmosphere.

14. The industrial package of claim 1, wherein the body further includes at least one long, flat shielding with ends affixed to an interior of the body, the shielding spanning the length or width of the body to compartmentalize the interior of the body.

15. The industrial package of claim 14, wherein the body further includes a shielding box attached to the interior of the body, the shielding box configured to further compartmentalize the interior of the body.

16. The industrial package of claim 14, wherein the at least one shielding is capable of shielding one of gamma rays or neutron flux.

17. An industrial package comprising:

a body having a hollow interior and at least one substantially open side, the body including, at least one internal lid support spanning the at least one substantially open side, a plurality of equally-spaced tube skids attached to a bottom surface of the body so as to create a clearance between the bottom surface and the ground, at least one unistrut attached to an interior of the body, at least one valve, the at least one valve permitting only one-way air flow into the industrial package so as to prevent depressurization of the industrial package, and at least one bumper-attached to an exterior of the body, the at least one bumper configured to reinforce the body against pressure differences;

a lid adjoining the body and movable about the body, the lid shaped so as to close the at least one substantially open side of the body when placed in a closed position, the lid including, at least one collapsible corner reinforcement, and a lattice support configured to be removably attached to the lid; and a multi-seal between the body and the lid, the multi-seal configured to seal the lid and the body when the lid is placed in the closed position such that the industrial package is air-tight and maintains an independent internal pressure, the industrial package complying with a water spray test, a free drop test, a stacking test, a penetration test, and a pressurization test when the lid is sealed against the body.

18. An industrial package comprising:

a body having a hollow interior and at least one substantially open side;

a lid adjoining the body and movable about the body, the lid shaped so as to close the at least one substantially open side of the body when placed in a closed position; and a multi-seal between the body and the lid, the multi-seal configured to seal the lid and the body when the lid is placed in the closed position such that the industrial package is air-tight and maintains an independent internal pressure, the industrial package complying with a water spray test, a free drop test, a stacking test, a penetration test, and a pressurization test when the lid is sealed against the body, wherein the body further includes at least one valve, the at least one valve permitting only one-way air flow into the industrial package so as to prevent depressurization of the industrial package.

19. The industrial package of claim 18, wherein the at least one valve includes a filter configured to filter radioactive particles passing through the valve.

* * * * *